US007616907B2

(12) United States Patent
Kim et al.

(10) Patent No.: US 7,616,907 B2
(45) Date of Patent: Nov. 10, 2009

(54) PRINTER CARTRIDGE

(75) Inventors: Young-min Kim, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 61 days.

(21) Appl. No.: 11/282,701

(22) Filed: Nov. 21, 2005

(65) Prior Publication Data

US 2006/0165434 A1 Jul. 27, 2006

(30) Foreign Application Priority Data

Jan. 26, 2005 (KR) ..... 10-2005-0007058

(51) Int. Cl.
*G03G 15/00* (2006.01)
*G03G 21/16* (2006.01)
*G03G 21/18* (2006.01)

(52) U.S. Cl. ..... 399/25; 399/111; 399/114

(58) Field of Classification Search ..... 399/25, 399/111, 113, 114
See application file for complete search history.

(56) References Cited

U.S. PATENT DOCUMENTS 5,669,042 A * 9/1997 Kobayashi et al. ..... 399/111
5,974,287 A * 10/1999 Kurz et al. ..... 399/114
6,236,822 B1 * 5/2001 Kawaguchi ..... 399/114
6,317,573 B1 * 11/2001 Baker et al. ..... 399/114
6,681,089 B2 * 1/2004 Dougherty ..... 399/111
6,760,558 B2 * 7/2004 Chadani et al. ..... 399/114
7,072,603 B2 * 7/2006 Tsuzuki et al. ..... 399/111
2002/0106222 A1 8/2002 Chadani et al.
2003/0231897 A1 12/2003 Dougherty

OTHER PUBLICATIONS

Office Action issued in Chinese Patent Application No. 2006100061833 on Jan. 4, 2008.

* cited by examiner

*Primary Examiner*—Sandra L Brase
(74) *Attorney, Agent, or Firm*—Stein McEwen, LLP

(57) ABSTRACT

A printer cartridge comprising a photosensitive body being in contact with a charging roller and a developing roller, the printer cartridge including a first member interposed between the charging roller and the photosensitive body; and a second member connected to the first member and interposed between the developing roller and the photosensitive body. Thus, aspects of the present invention provide a printer cartridge, in which problems due to contact between rollers while being circulated on the market are prevented.

42 Claims, 9 Drawing Sheets

PRINTER CARTRIDGE

CROSS-REFERENCE TO RELATED APPLICATIONS

This application claims the benefit of Korean Patent Application No. 2005-7058, filed on Jan. 26, 2005 in the Korean Intellectual Property Office, the disclosure of which is incorporated herein by reference.

BACKGROUND OF THE INVENTION

1. Field of the Invention

Aspects of the present invention relate to a printer cartridge, and more particularly, to a printer cartridge comprising an element to prevent contact between rollers.

2. Description of the Related Art

After a printer cartridge is completely assembled in a manufacturing process, the printer cartridge is used to perform test printing for quality examination. Depending on an outcome of the test printing, the printer cartridge that has passed the quality examination is packaged and put on the market.

In such a printer cartridge that has undergone and passed the test printing, a toner used in the test printing remains in a developing roller provided in the printer cartridge. Further, the remaining toner exists in a photosensitive body (e.g., organic photo conductor (OPC) roller) in contact with the developing roller. Furthermore, the remaining toner exists in a charging roller in contact with the photosensitive body. Moreover, the remaining toner exists in a pressed state on a contact surface between the developing roller and the photosensitive body and a contact surface between the photosensitive body and the charging roller.

Accordingly, the printer cartridge is packaged with the remaining toner and put on the market, and therefore a problem arises in that the remaining toner left on the contact surface between the rollers (i.e., this refers to the OPC roller and the developing roller and/or the OPC roller and the charging roller) solidifies. Such a solidified toner disposed between the rollers causes a stripe pattern to appear on printing paper when the printer cartridge is practically used. That is, in a case that the solidified toner sticks to the developing roller, a toner is not suitably controlled to be layered on the developing roller, and thus a large amount of toner is applied, thereby being darkly printed on a corresponding portion of the printing paper. Further, in a case that the solidified toner sticks to the photosensitive body, a toner is not developed on the photosensitive body, and thus a white band pattern is printed on a corresponding portion of the printing paper. Furthermore, even though the solidified toner is detached little by little from the roller due to friction between the rollers, a considerably long time (i.e., typically, printing for approximately one hundred pieces of printing paper) is needed until the printer cartridge performs normal clear printing.

In the meanwhile, even though the toner does not exist between the rollers, in a case where the printer cartridge is not kept within a proper temperature and humidity range, low molecular elements may ooze from the developing roller, the charging roller and the photosensitive body, which is called migration. In this case, a band is formed on a contact portion of each roller due to the low molecular elements, so that black or white patterns appear on a corresponding portion of the printing paper.

SUMMARY OF THE INVENTION

Accordingly, it is an aspect of the present invention to provide a printer cartridge, which prevents problems due to contact between rollers while being circulated on the market.

Additional aspects and/or advantages of the present invention will be set forth in part in the description which follows and, in part, will be obvious from the description, or may be learned by practice of the present invention.

The foregoing and/or other aspects of the present invention are also achieved by providing a printer cartridge comprising a photosensitive body being in contact with a charging roller and a developing roller, the printer cartridge comprising a first member interposed between the charging roller and the photosensitive body; and a second member connected to the first member and interposed between the developing roller and the photosensitive body.

According to an aspect of the present invention, the printer cartridge further comprises a retractable member connected to the first member and the second member.

According to an aspect of the present invention, the first member, the second member and the retractable member are formed as a single body.

According to an aspect of the present invention, the printer cartridge further comprises a casing formed with an opening through which the retractable member is drawn out.

According to an aspect of the present invention, the casing comprises a first casing supporting the charging roller, and a second casing supporting the developing roller and hingedly coupled with the first casing.

According to an aspect of the present invention, at least one of the first member and the second member comprises a pair of interposition parts interposed between corresponding rollers at opposite sides thereof, and a connection part connecting the interposition parts with each other.

The foregoing and/or other aspects of the present invention are also achieved by providing a printer cartridge comprising a photosensitive body being in contact with a charging roller and a developing roller at a predetermined angle, the printer cartridge comprising an interposition member interposed at least either between the charging roller and the photosensitive body or between the developing roller and the photosensitive body; and a cover connected to the interposition member and covering a portion of the photosensitive body exposed to the outside of the printer cartridge.

According to an aspect of the present invention, the printer cartridge further comprises a rotatable arm having a first end hingedly coupled to the cover, and a casing supporting rotation of the rotatable arm to allow the cover to open and cover the portion of the photosensitive body exposed to the outside, wherein the interposition member is drawn out by the cover when the rotation of the rotatable arm causes the cover to open the portion of the photosensitive body exposed to the outside.

According to an aspect of the present invention, the rotatable arm is rotated by a printer main body while the printer cartridge is mounted to the printer main body, to allow the cover to open the exposed portion of the photosensitive body.

According to an aspect of the present invention, the rotatable arm further comprises a restoring unit to restore the cover to cover the exposed portion of the photosensitive body when the printer cartridge is removed from the printer main body, and the interposition member slides along a surface of the casing when the cover is restored.

The foregoing and/or other aspects of the present invention are also achieved by providing a printer cartridge comprising a photosensitive body being in contact with a charging roller and a developing roller at a predetermined angle, the printer cartridge comprising an interposition member interposed at least either between the charging roller and the photosensitive body or between the developing roller and the photosensitive body; and a cover member connected to the interposition member and covering a portion of the photosensitive body exposed to the outside of the printer cartridge.

According to an aspect of the present invention, the interposition member and the cover member are formed as a single body.

According to an aspect of the present invention, the printer cartridge further comprises a casing to support one end of the cover member.

According to an aspect of the present invention, the casing comprises a first casing supporting the charging roller, and a second casing supporting the developing roller and hingedly coupled with the first casing.

According to an aspect of the present invention, the printer cartridge further comprises a retractable member connected to the cover member.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
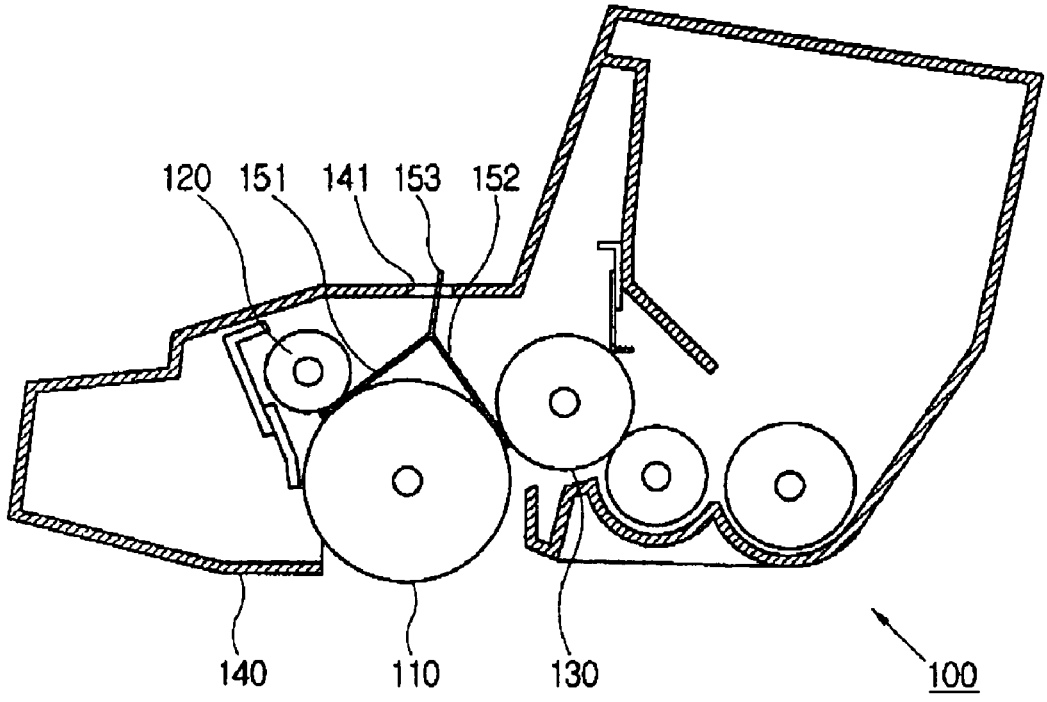
FIG. 1 is a sectional view of a printer cartridge according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

As shown in FIG. 1, a printer cartridge 100 according to an embodiment of the present invention comprises a photosensitive body 110 used as a roller for printing an image on printing paper; a charging roller 120 rotating in contact with the photosensitive body 110 and charging a surface of the photosensitive body 110 with predetermined electric potential; a developing roller 130 rotating in contact with the photosensitive body 110 at a predetermined angle with respect to a contact point between the photosensitive body 110 and the charging roller 120 and transferring a toner to the photosensitive body 110; and a casing 140 supporting the photosensitive body 110, the charging roller 120 and the charging roller 130. Further, referring to FIGS. 1 and 2, the printer cartridge 100 comprises a first member 151 interposed between the charging roller 120 and the photosensitive body 110, a second member 152 connected with the first member 151 and interposed between the developing roller 130 and the photosensitive body 110, and a retractable member 153 connected to the first and second members 151 and 152. Each of the first and second members 151 and 152 has a thickness of about 0.1 mm, though other thicknesses are possible. Here, the charging roller 120 and the photosensitive body 110 are spaced from each other by the thickness of the first member 151. Likewise, the developing roller 130 and the photosensitive body 110 are spaced from each other by the thickness of the second member 152. In a case where the charging roller 120 and the developing roller 130 are provided as a contact type roller, the charging roller 120 and the developing roller 130 are elastically pressed toward the photosensitive body 110 by an elastic-pressing member (not shown) such as a spring or the like, so that they have a structure to accommodate the members and be spaced by the thickness of the member. On the other hand, in a case where the charging roller 120 and the developing roller 130 are provided as a contactless type roller, the rollers have a space to accommodate the member.

The retractable member 153 has a first end protruding outside the casing 140 through an opening 141 formed in the casing 140. The protruded portion of the retractable member 153 is used as a grip for a user, so that the protruded portion is drawn out through the opening 141 when the printer cartridge 100 is to be used. To facilitate drawing out the retractable member 153, the retractable member 153 may be formed with a separate grip. Preferably, the retractable member 153 is formed integrally with the first and second members 151 and 152. Alternatively, the retractable member may be formed separately from the first and second member and connected with both members. As the opening 141, it is possible to use an existing passage for light emitted from an optical unit such as a laser-scanning unit (not shown) to the photosensitive body 110. Alternatively, the opening may be formed in a predetermined portion of the casing 140 without utilizing the existing passage. For example, the opening may be formed in a lateral side of the casing 140. In this case, the retractable member 153 is laterally drawn out from the printer cartridge 100. The first member 151, the second member 152 and the retractable member 153 may be formed of any suitable material, such as a plastic, a cardboard or a metal strip to perform the function of preventing the toner from solidifying on at least one of the rollers during commercial distribution.

Figure 2:
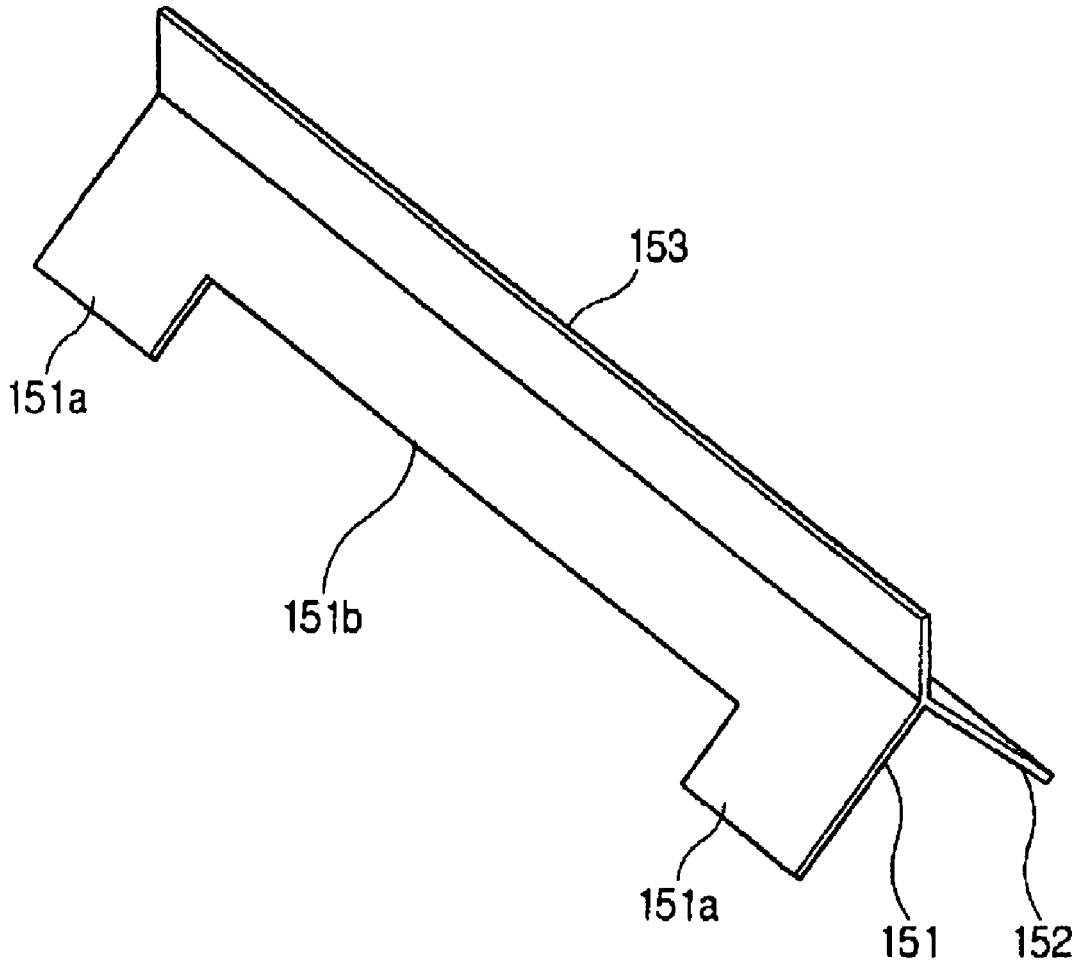
FIG. 2 is a perspective view of an element of the printer cartridge according to the embodiment of the present invention shown in FIG. 1.
Figure 3:
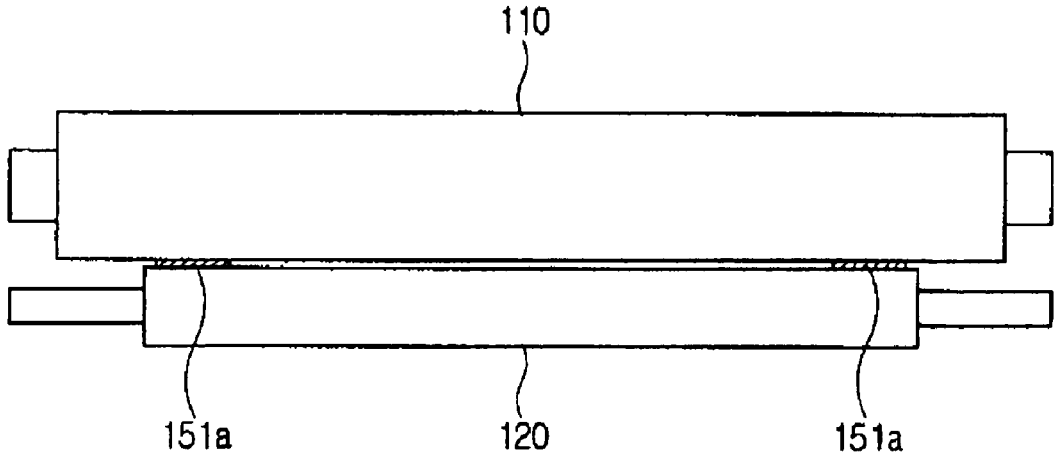
FIGS. 3 and 4 are views illustrating use of the printer cartridge according to the embodiment of the present invention shown in FIG. 1.
Figure 4:
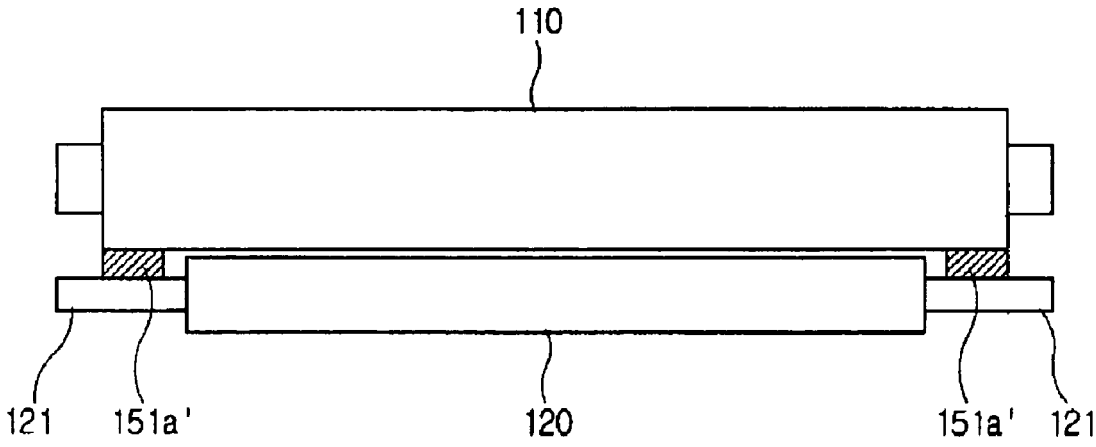

Referring to FIG. 2, each of the first member 151 and the second member 152 comprises a pair of interposition parts 151*a* protruded from opposite sides of each member, and a connection part 151*b* connecting the interposition parts 151*a* with each other. In the case of the first member 151, both the interposition parts 151*a* are interposed between the photosensitive body 110 and the charging roller 120 at opposite sides thereof (refer to FIG. 3). Thus, unnecessary contact between the first member 151 and the rollers (i.e., the photosensitive body and the charging roller) is minimized. In another aspect only one of the first and second members 151 and 152 include the interposition parts 151*a* and connection part 151*b*. Alternatively, in order to avoid direct contact between the first member 151 and the rollers, an interposition part 151*a* may be interposed between a shaft 121 of the charging roller 120 and the photosensitive body 110 at an opposite side thereof (referring to FIG. 4). In this case, the thickness of the interposition part 151*a* increases compared to that shown in FIG. 3.

Figure 5:
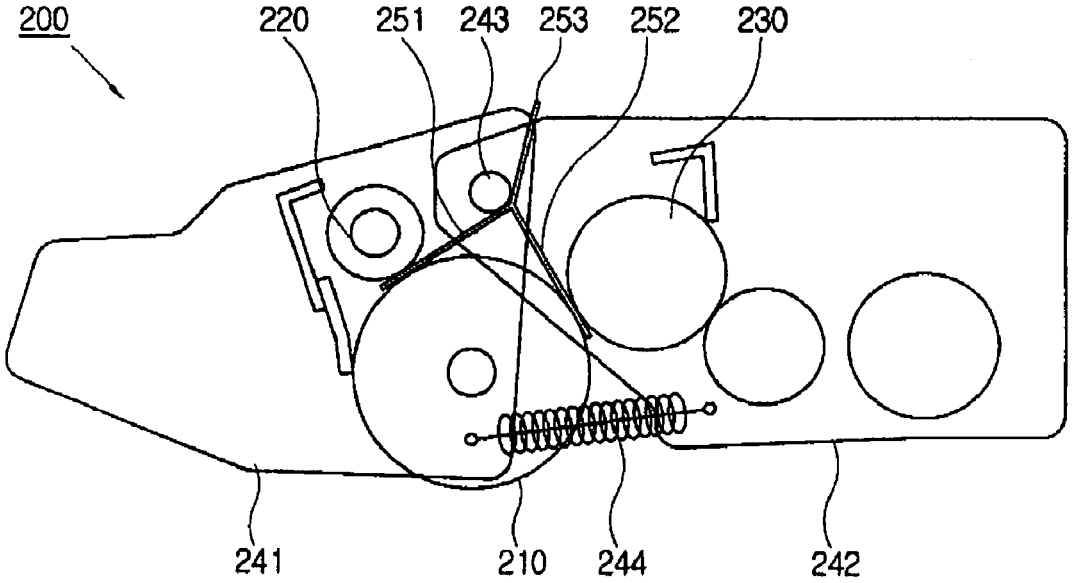
FIG. 5 is a sectional view of a printer cartridge according to another embodiment of the present invention.

As shown in FIG. 5, a printer cartridge 200 according to another embodiment of the present invention comprises a first casing 241 to support a charging roller 220 and a photosensitive body 210 rotating in contact with the charging roller 220, and a second casing 242 to support a developing roller 230 and hingedly coupled with the first casing 241 by a hinge 243. The first casing 241 and the second casing 242 are coupled to opposite ends of a spring 244 opposite to the hinge 243. Here, the photosensitive body 210 supported by the first casing 241 and the developing roller 230 supported by the second casing 242 are in contact with each other at a predetermined angle with respect to a contact point between the photosensitive body 210 and the charging roller 220. Further, the printer cartridge 200 according to the second embodiment of the present invention comprises a first member 251 interposed between the charging roller 220 and the photosensitive body 210, a second member 252 connected with the first member 251 and interposed between the developing roller 230 and the photosensitive body 210, and a retractable member 253 connected to the first member 251 and the second member 252. The retractable member 253 enables a user to move the first member 251 and the second member 252 between a first printing enabled position and a second printing disabled position.

Figure 6:
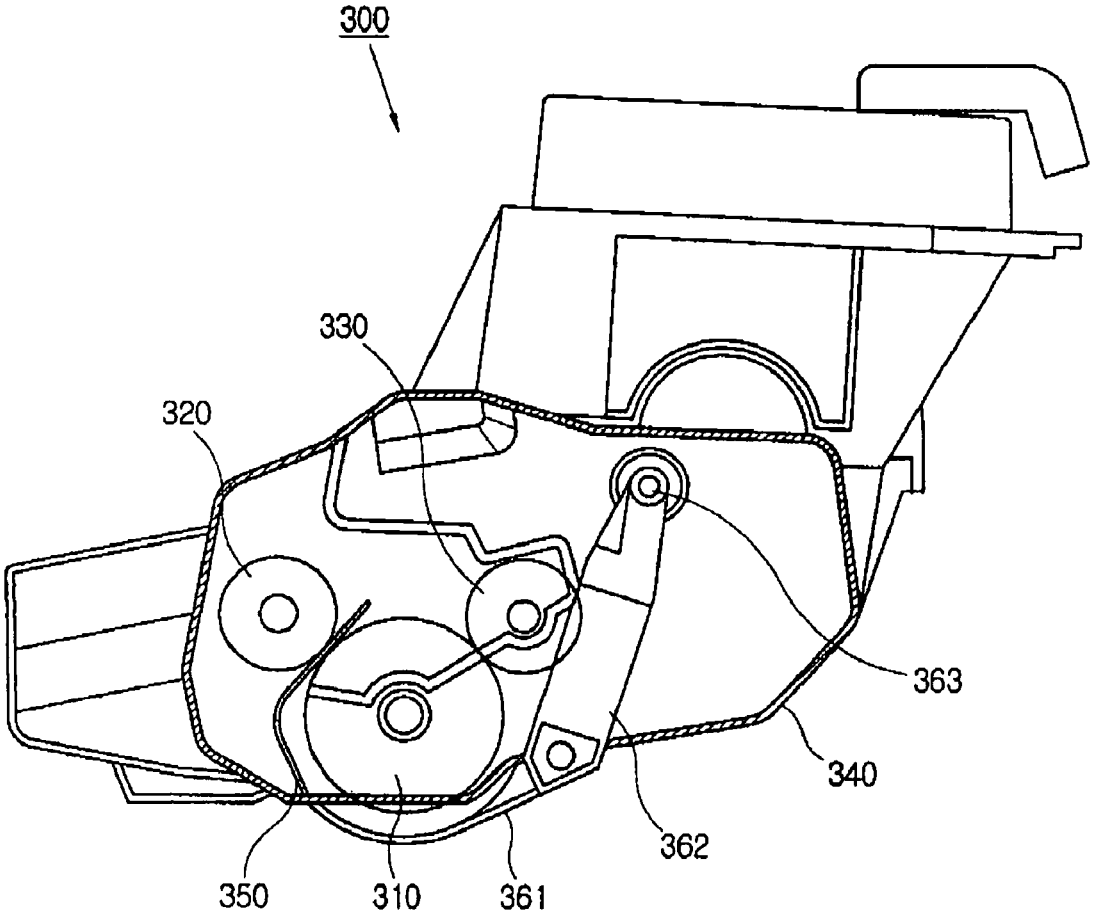
FIGS. 6 through 8 are sectional views of a printer cartridge according to another embodiment of the present invention.

As shown in FIG. 6, a printer cartridge 300 according to another embodiment of the present invention comprises a photosensitive body 310 to print an image on printing paper; a charging roller 320 rotating in contact with the photosensitive body 310 and charging a surface of the photosensitive body 310 with predetermined electric potential; a developing roller 330 rotating in contact with the photosensitive body 310 at a predetermined angle with respect to a contact point between the photosensitive body 310 and the charging roller 320 and transferring a toner to the photosensitive body 310; and a casing 340 supporting the photosensitive body 310, the charging roller 320 and the developing roller 330. Further, the printer cartridge 300 comprises an interposition member 350 interposed between the charging roller 320 and the photosensitive body 310, and a cover 361 connected with the interposition member 350 and partially covering the photosensitive body 310 exposed to the outside environment. Here, the cover 361 prevents the photosensitive body 310 from being damaged due to contact with the outside. The cover 361 has a first end hingedly coupled to a rotatable arm 362. The rotatable arm 362 has a first end coupled to the casing 340 by a hinge 363. Further, the hinge 363 is provided with an elastic restoring unit (not shown) to elastically restore the rotatable arm 362 when the rotatable arm 362 rotates counterclockwise with respect to the hinge 363.

The interposition member 350 has a similar structure and the same function as the first member 151 and the second member 152 according to the first embodiment of the present invention illustrated in FIG. 1. According to the embodiment of the present invention shown in FIG. 6, the interposition member 350 is interposed only between the charging roller 320 and the photosensitive body 310. Alternatively, the interposition member 350 may extend to be interposed between the developing roller 330 and the photosensitive body 310.

Figure 7:
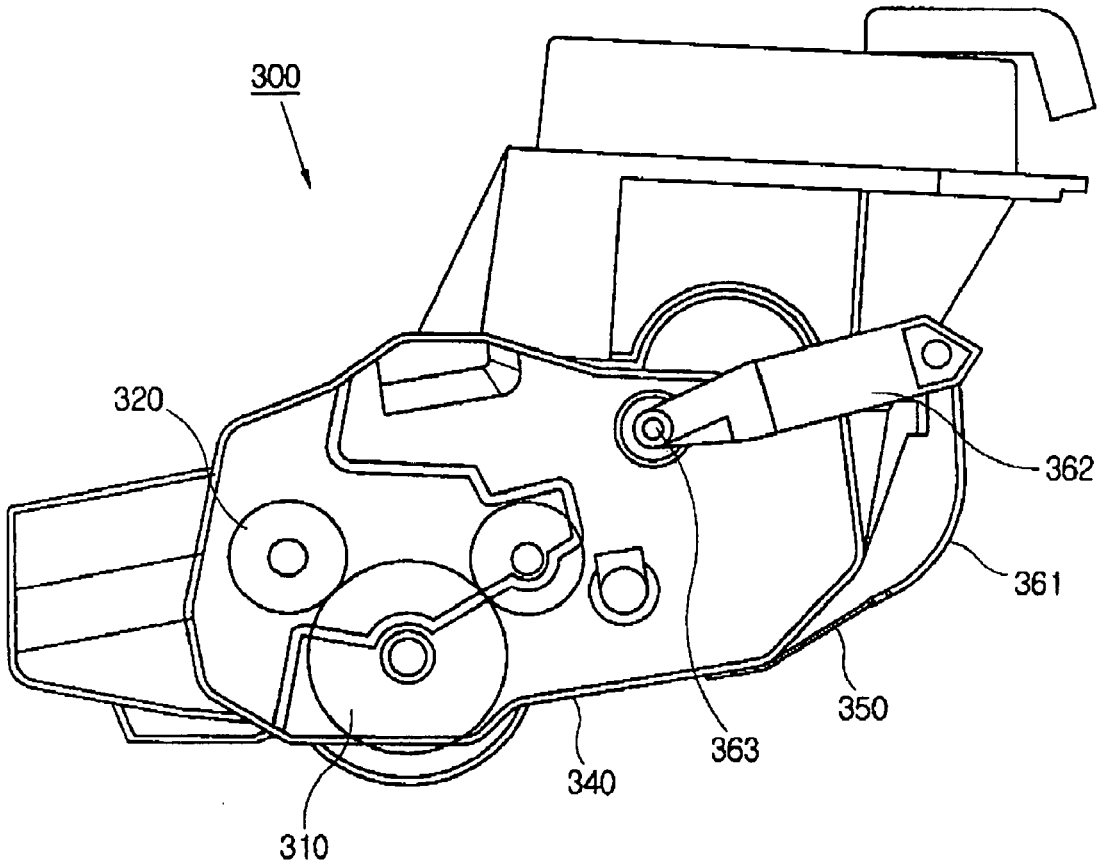

Thus, in a case where the printer cartridge 300 is inserted in a printer main body (not shown), the rotatable arm 362 is rotated counterclockwise by a projection (not shown) provided in the printer main body (refer to FIG. 7), so that the cover 361 moves rightward and opens the photosensitive body 310. Then, the opened photosensitive body 310 faces and contacts a printing roller (not shown) provided in the printer main body. At this time when the cover 361 moves rightward by the rotatable arm 362, the interposition member 350 is drawn out from between the charging roller 320 and the photosensitive body 310 such that the printer cartridge is ready to be used for printing.

Figure 8:
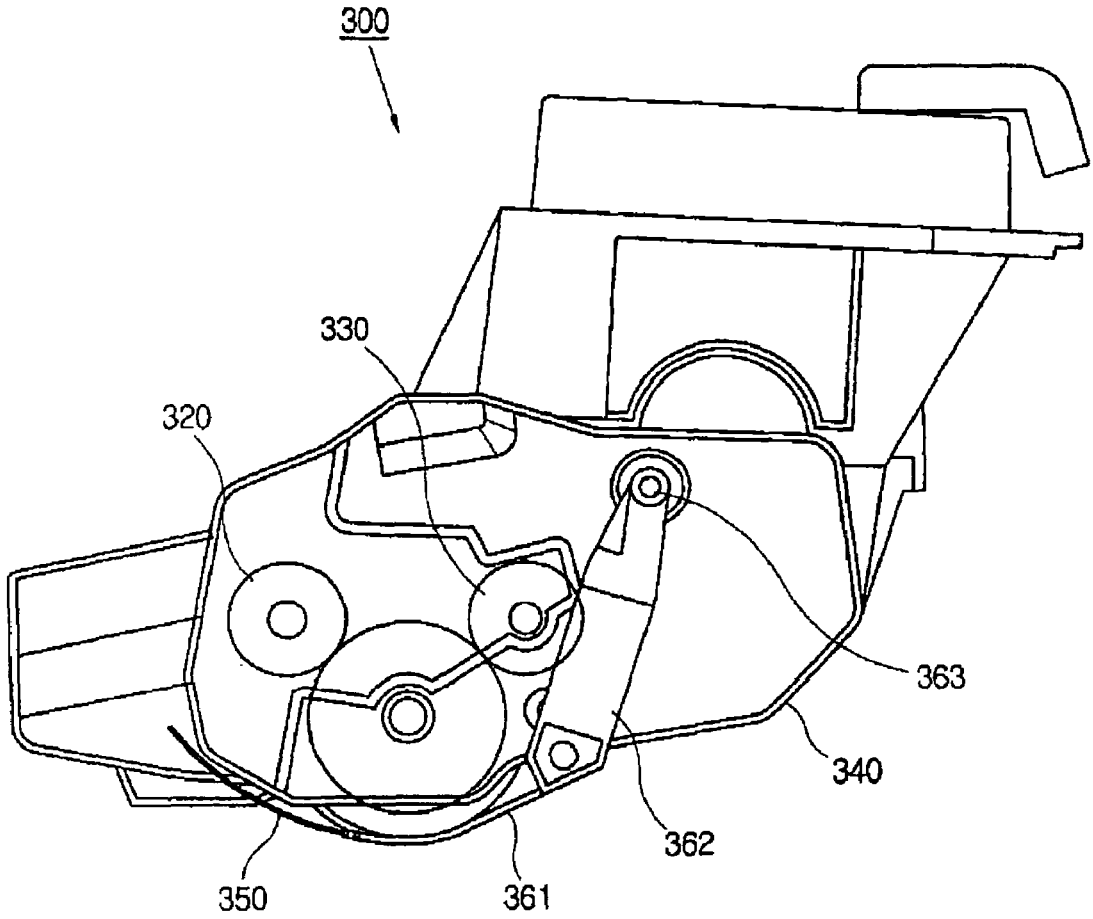

On the other hand, in a case where the printer cartridge 300 is removed from the printer main body, the rotatable arm 362 rotates clockwise by the restoring unit provided in the hinge 363 (refer to FIG. 8) and thus the cover 361 is restored to cover the photosensitive body 310. At this time, the interposition member 350 slides toward the front of the printer cartridge 300 (leftward with respect to FIG. 8) along the surface of the casing 340.

Figure 9:
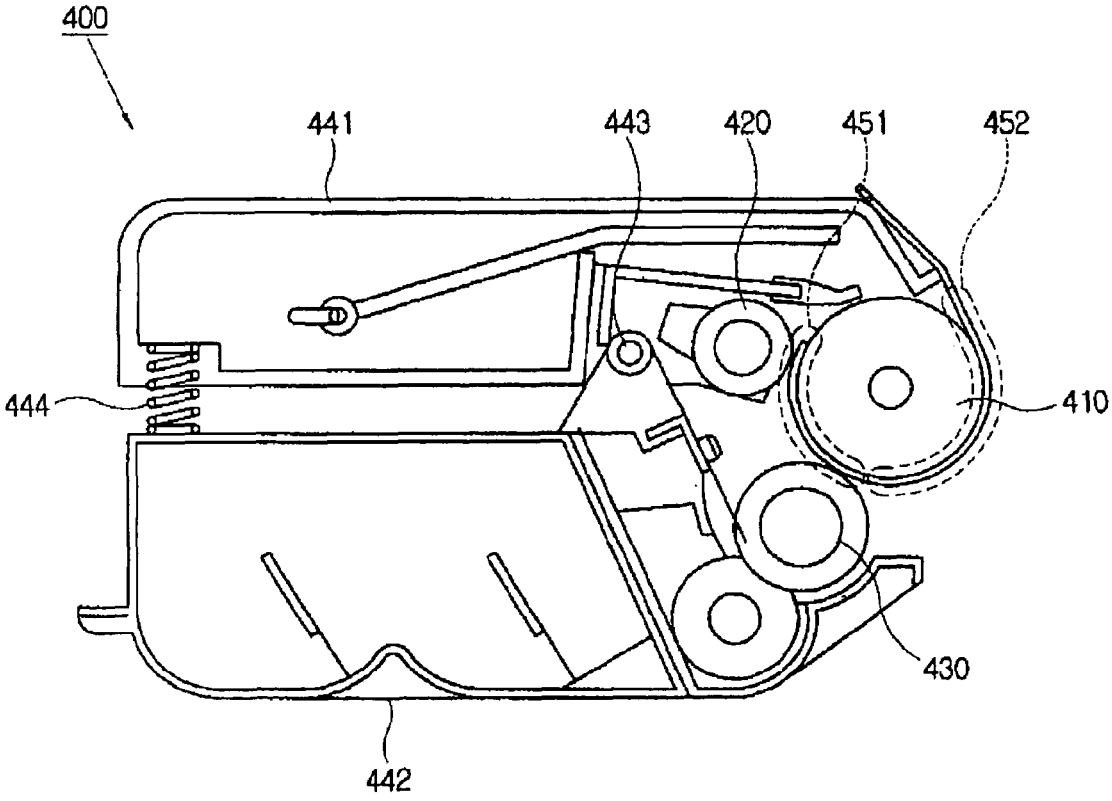
FIG. 9 is a sectional view of a printer cartridge according to another embodiment of the present invention.

As shown in FIG. 9, a printer cartridge 400 according to another embodiment of the present invention comprises a first casing 441 to support a charging roller 420 and a photosensitive body 410 rotating in contact with the charging roller 420, and a second casing 442 placed under the first casing 441, supporting a developing roller 430 and hingedly coupled with the first casing 441 by a hinge 443. The first casing 441 and the second casing 442 are elastically coupled to a spring 444 placed in a predetermined side of the first and second casings 441 and 442, so that the photosensitive body 410 and the developing roller 430 are pressed in contact with each other at a predetermined angle with respect to a contact point between the photosensitive body 410 and the charging roller 420. Further, an interposition member 451 is formed as a single body and interposed not only between the charging roller 420 and the photosensitive body 410 but also the developing roller 430 and the photosensitive body 410.

The printer cartridge with this configuration does not comprise a cover like, for example, the cover 361 illustrated in FIG. 6. Therefore, a portion of the photosensitive body 410 that is exposed to the outside is relatively damage prone. Therefore, the printer cartridge 400 illustrated in FIG. 9 comprises a cover 452 extending from the interposition member 451 and partially covering the photosensitive body 410 exposed to the outside. Here, the interposition member 451 and the cover 452 may be formed as a single body. Alternatively, the interposition member 451 and the cover 452 may be made of different materials and connected to each other. Further, the interposition member 451 may be interposed only between the developing roller 430 and the photosensitive body 410. Here, the cover 452 surrounds the exposed portion of the photosensitive body 410, and has an end portion attached to and supported by the first casing 441. When the printer cartridge 400 provided with the interposition member 451 and the cover 452 is used, a user grips the end portion of the cover 452 attached to the first casing 441 and rotates the cover 452 clockwise with respect to the photosensitive body 410, thereby opening the photosensitive body 410. Then, a user pulls the cover 452, thereby drawing out the interposition member 451.

As described above, aspects of the present invention provide a printer cartridge, which prevents problems due to contact between rollers while being circulated on the market. Particularly, elements forming a toner and a roller are prevented from being solidified, and a photosensitive body is protected from being damaged by a charging roller and a developing roller due to external impact. Further, even though the printer cartridge does not comprise a cover, the photosensitive body is protected from the outside.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A printer cartridge comprising a photosensitive body, a charging roller and a developing roller, the printer cartridge comprising:

a first member interposed between the charging roller and the photosensitive body such that the charging roller is kept substantially separated from the photosensitive body, to prevent the photosensitive body from being damaged by the charging roller due to external impact; and a second member connected to the first member and interposed between the developing roller and the photosensitive body such that the developing roller is kept substantially separated from the photosensitive body, to prevent the photosensitive body from being damaged by the developing roller due to external impact, wherein the first member and the second member are movable between a first position enabling printing and a second position disabling printing, and wherein at least one of the first member and the second member comprises a pair of interposition parts interposed between a corresponding one of the charging roller and the photosensitive body and/or the developing roller and the photosensitive body at opposite sides thereof, and a connection part connecting the interposition parts with each other.

2. The printer cartridge according to claim 1, further comprising a retractable member connected to the first member and the second member.

3. The printer cartridge according to claim 2, wherein the first member, the second member and the retractable member are formed as a single body.

4. The printer cartridge according to claim 2, further comprising a casing formed with an opening through which the retractable member is drawn out, the casing supporting the charging roller and the developing roller.

5. The printer cartridge according to claim 4, wherein the casing comprises a first casing supporting the charging roller, and a second casing supporting the developing roller and hingedly coupled with the first casing.

6. A printer cartridge comprising a photosensitive body, a charging roller and a developing roller, the printer cartridge comprising:

a first member interposed between the charging roller and the photosensitive body; and a second member connected to the first member and interposed between the developing roller and the photosensitive body, wherein the first member and the second member are movable between a first position enabling printing and a second position disabling printing, and wherein at least one of the first member and the second member comprises a pair of interposition parts interposed between a corresponding one of the charging roller and photosensitive body and/or the developing roller and the photosensitive body at opposite sides thereof, and a connection part connecting the interposition parts with each other.

7. A printer cartridge comprising a photosensitive body being in contact with a charging roller and a developing roller at a predetermined angle, the printer cartridge comprising:

an interposition member interposed at least either between the charging roller and the photosensitive body or between the developing roller and the photosensitive body such that the charging roller and the developing roller are kept substantially separated from the photosensitive body, to prevent the photosensitive body from being damaged by at least one of the charging roller and the developing roller due to external impact; and a cover connected to the interposition member to cover a portion of the photosensitive body exposed to the outside of the printer cartridge, wherein the cover is movable or rotatable between a first position to cover the portion of the photosensitive body and a second position to uncover the portion of the photosensitive body, and wherein the interposition member comprises a pair of interposition parts interposed between a corresponding one of the charging roller and the photosensitive body and/or the developing roller and the photosensitive body at opposite sides thereof, and a connection part connecting the interposition parts with each other.

8. A printer cartridge comprising a photosensitive body being in contact with a charging roller and a developing roller at a predetermined angle, the printer cartridge comprising:

an interposition member interposed at least either between the charging roller and the photosensitive body or between the developing roller and the photosensitive body;

a cover connected to the interposition member to cover a portion of the photosensitive body exposed to the outside of the printer cartridge;

a rotatable arm having a first end hingedly coupled to the cover; and a casing supporting rotation of the rotatable arm to allow the cover to selectively uncover and cover the portion of the photosensitive body exposed to the outside of the printer cartridge, wherein the cover is movable or rotatable between a first position to cover the portion of the photosensitive body and a second position to uncover the portion of the photosensitive body, and wherein the interposition member is drawn out by the cover when the rotation of the rotatable arm causes the cover to uncover the portion of the photosensitive body exposed to the outside of the printer cartridge.

9. The printer cartridge according to claim 8, wherein the rotatable arm is rotated by a printer main body while the printer cartridge is mounted to the printer main body, to cause the cover to uncover the exposed portion of the photosensitive body.

10. The printer cartridge according to claim 9, wherein the rotatable arm further comprises a restoring unit to restore the cover to cover the exposed portion of the photosensitive body when the printer cartridge is removed from the printer main body, and the interposition member slides along a surface of the casing when the cover is restored.

11. The printer cartridge according to claim 8, wherein the interposition member is interposed between the charging roller and the photosensitive body and between the developing roller and the photosensitive body.

12. A printer cartridge comprising a photosensitive body being in contact with a charging roller and a developing roller at a predetermined angle, the printer cartridge comprising:

an interposition member interposed at least either between the charging roller and the photosensitive body or between the developing roller and the photosensitive body such that the charging roller and the developing roller are kept substantially separated from the photosensitive body, to prevent the photosensitive body from being damaged by at least one of the charging roller and the developing roller due to external impact; and a cover member connected to the interposition member to cover a portion of the photosensitive body exposed to the outside of the printer cartridge, wherein the interposition member is movable between a first position enabling printing and a second position disabling printing and comprises a pair of interposition parts interposed between a corresponding one of the charging roller and the photosensitive body and/or the developing roller and the photosensitive body at opposite sides thereof and a connection part connecting the interposition parts with each other.

13. The printer cartridge according to claim 12, wherein the interposition member and the cover member are formed as a single body.

14. The printer cartridge according to claim 12, further comprising a casing to support one end of the cover member.

15. The printer cartridge according to claim 14, wherein the casing comprises a first casing supporting the charging roller, and a second casing supporting the developing roller and hingedly coupled with the first casing.

16. The printer cartridge according to claim 15, wherein the interposition member is interposed between the charging roller and the photosensitive body and between the developing roller and the photosensitive body.

17. The printer cartridge according to claim 12, further comprising a retractable member connected to the cover member configured to control the cover member to move between the first position and the second position.

18. The printer cartridge according to claim 12, wherein the interposition member is interposed between the charging roller and the photosensitive body and between the developing roller and the photosensitive body.

19. A printer cartridge for use with a printer, comprising:

a casing configured to hold a first roller, a second roller, a third roller and a toner in a predetermined relationship suitable for printing; and an interposition member disposed at a first position to prevent the toner from solidifying on or exposing at least two of the first roller, the second roller and the third roller during periods when the printer cartridge is not installed in the printer, wherein the first roller, the second roller and the third roller are kept substantially separated from each other by means of the interposition member, and wherein the interposition member is movable from the first position to a second position for enabling printing and comprises a pair of interposition parts interposed between at least two of the first roller, the second roller and the third roller at opposite sides thereof, and a connection part connecting the interposition parts with each other.

20. The printer cartridge according to claim 19, wherein the casing comprises a first casing supporting the first roller and the third roller, and a second casing supporting the second roller, the second casing resiliently coupled with the first casing.

21. A printer cartridge comprising:

a charging roller;

a developing roller;

a photosensitive body arranged in contact with the charging roller and the developing roller; and a retractable cover in an inverted Y-shape having a first member interposed between the charging roller and the photosensitive body, and a second member interposed between the developing roller and the photosensitive body, to prevent toner from solidifying on at least one of the charging roller, the developing roller and the photosensitive body, wherein at least one of the first member and the second member comprises a pair of interposition parts interposed between a corresponding one of the charging roller and photosensitive body and/or the developing roller and the photosensitive body at opposite sides thereof, and a connection part connecting the interposition parts with each other.

22. The printer cartridge according to claim 21, further comprising a casing to support the charging roller and the developing roller, and provided with an opening through which the retractable member is drawn out to remove the first member from between the charging roller and the photosensitive body and the second member from between the developing roller and the photosensitive body.

23. The printer cartridge according to claim 22, wherein the casing comprises a first casing supporting the charging roller, and a second casing supporting the developing roller and hingedly coupled with the first casing.

24. A printer cartridge comprising:

a photosensitive body;

a charging roller arranged relative to the photosensitive body in an enabling charging position;

a developing roller arranged relative to the photosensitive body in an enabling developing position; and an interposition member interposed at least either between the charging roller and the photosensitive body in a disabling charging position, or between the developing roller and the photosensitive body in a disabling developing position, such that at least one of the charging roller and the developing roller is kept substantially separated from the photosensitive body, to prevent the photosensitive body from being damaged by at least one of the charging roller and the developing roller due to external impact, wherein the interposition member is movable between a first position enabling printing and a second position disabling printing and comprises a pair of interposition parts interposed between a corresponding one of the charging roller and the photosensitive body and/or the developing roller and the photosensitive body at opposite sides thereof and a connection part connecting the interposition parts with each other.

25. The printer cartridge according to claim 24, wherein the interposition member is interposed at least either between a shaft of the charging roller and the photosensitive body at an opposite side thereof or between a shaft of the developing roller and the photosensitive body at an opposite side thereof.

26. The printer cartridge according to claim 25, further comprising a retractable member connected to the interposition member.

27. The printer cartridge according to claim 26, further comprising a casing formed with an opening through which the retractable member is drawn out, the casing supporting the charging roller and the developing roller.

28. The printer cartridge according to claim 27, wherein the opening is formed in a lateral side of the casing.

29. The printer cartridge according to claim 28, wherein the retractable member is laterally drawn out from the printer cartridge.

30. The printer cartridge according to claim 27, wherein the casing comprises a first casing supporting the charging roller, and a second casing supporting the developing roller and hingedly coupled with the first casing.

31. The printer cartridge according to claim 30, wherein the first casing further supports the photosensitive roller rotating in contact with the charging roller.

32. The printer cartridge according to claim 31, wherein the first casing and the second casing are elastically coupled to opposite ends of a spring.

33. The printer cartridge according to claim 32, wherein the photosensitive body and the developing roller are elastically pressed in contact with each other by the spring.

34. A printer cartridge comprising:

a photosensitive body;

a charging roller;

a developing roller;

at least one biasing member configured to bias at least one of the charging roller and the developing roller toward the photosensitive body to make contact with the photosensitive body; and a separating member configured to substantially keep the charging roller separated from the photosensitive body in an opposite direction of the biasing to prevent the photosensitive body from being damaged by the charging roller due to external impact, and configured to substantially keep the developing roller separated from the photosensitive body in the opposite direction of the biasing, to prevent the photosensitive body from being damaged by the developing roller due to external impact, wherein the separating member is movable between a first position enabling printing and a second position disabling printing and comprises a pair of separating parts provided at opposite sides of at least one of the photosensitive body, the charging roller and the developing roller.

35. The printer cartridge according to claim 34, wherein the separating member comprises a handle member.

36. A printer cartridge comprising:

a charging roller;

a developing roller;

a photosensitive body in contact with the charging roller and the developing roller;

a space maintaining member comprising:

a first member configured to maintain a first predetermined space between the charging roller and the photosensitive body to prevent the photosensitive body from being damaged by the charging roller due to external impact;

a second member configured to maintain a second predetermined space between the developing roller and the photosensitive body, to prevent the photosensitive body from being damaged by the developing roller due to external impact; and a third member integrally connected to the first member and the second member, and configured to allow a user to move the space maintaining member between a first position enabling printing and a second position disabling printing, wherein at least one of the first member and the second member comprises a pair of separating parts provided at opposite sides of at least one of the photosensitive body, the charging roller and the developing roller.

37. A printer cartridge comprising:

a casing comprising a photosensitive roller in contact with a charging roller and a developing roller; and an isolation device configured to isolate the charging roller from the photosensitive roller by maintaining a first predetermined space therebetween to prevent the photosensitive body from being damaged by the charging roller due to external impact, and configured to isolate the developing roller from the photosensitive roller by maintaining a second predetermined space therebetween to prevent the photosensitive body from being damaged by the developing roller due to external impact, wherein the casing is provided with an opening to receive the isolation device, and wherein the isolation device is movable between a first position enabling printing and a second position disabling printing in the opening and comprises a pair of isolating parts provided at opposite sides of at least one of the photosensitive body, the charging roller and the developing roller.

38. A printer cartridge comprising:

a photosensitive body;

a charging roller arranged relative to the photosensitive body in an enabling charging position;

a developing roller arranged relative to the photosensitive body in an enabling developing position; and an interposition member interposed at least either between the charging roller and the photosensitive body in a disabling charging position, or between the developing roller and the photosensitive body in a disabling developing position, such that at least one of the charging roller and the developing roller is kept substantially separated from the photosensitive body, to prevent at least one of the charging roller and the developing roller from deformation due to contact with the photosensitive body, wherein the interposition member is movable between a first position enabling printing and a second position disabling printing and comprises a pair of interposition parts interposed between a corresponding one of the charging roller and the photosensitive body and/or the developing roller and the photosensitive body at opposite sides thereof and a connection part connecting the interposition parts with each other.

39. A printer cartridge comprising:

a photosensitive body;

a charging roller;

a developing roller;

at least one biasing member configured to bias at least one of the charging roller and the developing roller toward the photosensitive body to make contact with the photosensitive body; and a separating member configured to substantially keep the charging roller separated from the photosensitive body in an opposite direction of the biasing to prevent the charging roller from deformation due to contact with the photosensitive body, and configured to substantially keep the developing roller separated from the photosensitive body in the opposite direction of the biasing, to prevent the developing roller from deformation due to contact with the photosensitive body, wherein the separating member is movable between a first position enabling printing and a second position disabling printing and comprises a pair of separating parts provided at opposite sides of at least one of the photosensitive body, the charging roller and the developing roller.

40. A printer cartridge comprising:

a charging roller;

a developing roller;

a photosensitive body in contact with the charging roller and the developing roller;

a space maintaining member comprising:

a first member configured to maintain a first predetermined space between the charging roller and the photosensitive body to prevent the charging roller from deformation due to contact with the photosensitive body;

a second member configured to maintain a second predetermined space between the developing roller and the photosensitive body, to prevent the developing roller from deformation due to contact with the photosensitive body; and a third member integrally connected to the first member and the second member, and configured to allow a user to move the space maintaining member between a first position enabling printing and a second position disabling printing, wherein the at least one of the first member and the second member comprises a pair of separating parts provided at opposite sides of at least one of the photosensitive body, the charging roller and the developing roller.

41. A printer cartridge comprising:

a casing comprising a photosensitive roller in contact with a charging roller and a developing roller; and an isolation device configured to isolate the charging roller from the photosensitive roller by maintaining a first predetermined space therebetween to prevent the charging roller from deformation due to contact with the photosensitive body, and configured to isolate the developing roller from the photosensitive roller by maintaining a second predetermined space therebetween to prevent the developing roller from deformation due to contact with the photosensitive body, wherein the casing is provided with an opening to receive the isolation device, and wherein the isolation device is movable between a first position enabling printing and a second position disabling printing in the opening and comprises a pair of isolating parts provided at opposite sides of at least one of the photosensitive body, the charging roller and the developing roller.

42. A printer cartridge comprising a photosensitive body, a charging roller and a developing roller, the printer cartridge comprising:

a first member interposed between the charging roller and the photosensitive body such that the charging roller is kept substantially separated from the photosensitive body, to prevent the photosensitive body from being damaged by the charging roller due to external impact; and a second member connected to the first member and interposed between the developing roller and the photosensitive body such that the developing roller is kept substantially separated from the photosensitive body, to prevent the photosensitive body from being damaged by the developing roller due to external impact, wherein the first member and the second member are movable between a first position enabling printing and a second position disabling printing, and wherein at least one of the first member and the second member is interposed between a corresponding one of the charging roller and the photosensitive body and/or the developing roller and the photosensitive body in a non-image area of the photosensitive body so that an air gap is formed between a corresponding one of the charging roller and the photosensitive body and/or the developing roller and the photosensitive body in an image area of the photosensitive body.

* * * * *